US009160077B2

(12) United States Patent
Liu et al.

(10) Patent No.: US 9,160,077 B2
(45) **Date of Patent: *Oct. 13, 2015**

(54) ANTENNA BASED ON A METAMATERIAL AND METHOD FOR GENERATING AN OPERATING WAVELENGTH OF A METAMATERIAL PANEL

(75) Inventors: Ruopeng Liu, Guangdong (CN); Chunlin Ji, Guangdong (CN); Yutao Yue, Guangdong (CN)

(73) Assignees: KUANG-CHI INNOVATIVE TECHNOLOGY LTD., FuTian District, Shenzhen, Guangdong (CN); KUANG-CHI INSTITUTE OF ADVANCED TECHNOLOGY, Nanshan District, Shenzhen, Guangdong (CN)

( * ) Notice: Subject to any disclaimer, the term of this patent is extended or adjusted under 35 U.S.C. 154(b) by 469 days.

This patent is subject to a terminal disclaimer.

(21) Appl. No.: 13/522,952

(22) PCT Filed: Nov. 16, 2011

(86) PCT No.: PCT/CN2011/082311

§ 371 (c)(1), (2), (4) Date: Jul. 18, 2012

(87) PCT Pub. No.: WO2012/155471

PCT Pub. Date: Nov. 22, 2012

(65) Prior Publication Data

US 2012/0299788 A1 Nov. 29, 2012

(51) Int. Cl.
*H01Q 15/02* (2006.01)
*H01Q 19/06* (2006.01)

(52) U.S. Cl.
CPC ..... *H01Q 15/02* (2013.01); *H01Q 19/06* (2013.01)

(58) Field of Classification Search
CPC ..... H01Q 19/65; H01Q 15/02
USPC ..... 343/753, 909, 757, 761, 782; 375/338; 250/339.05, 482.1, 503.1; 359/642, 359/620, 321, 341.32, 586, 652
See application file for complete search history.

(56) References Cited

U.S. PATENT DOCUMENTS

2009/0201572 A1* 8/2009 Yonak ..... 359/316
2010/0225562 A1* 9/2010 Smith ..... 343/909

FOREIGN PATENT DOCUMENTS

CN 201515017 U 6/2010

* cited by examiner

*Primary Examiner* — Sue A Purvis
*Assistant Examiner* — Jae Kim
(74) *Attorney, Agent, or Firm* — Winston Hsu; Scott Margo

(57) ABSTRACT

The present invention relates to an antenna based on a metamaterial and a method for generating an operating wavelength of a metamaterial panel. The antenna comprises a radiation source, and a metamaterial panel capable of converging an electromagnetic wave and operating at a first wavelength. The metamaterial panel is adapted to convert the electromagnetic wave radiated from the radiation source into a plane wave and to enable the antenna to simultaneously operate at a second wavelength and a third wavelength which are smaller than the first wavelength and are different multiples of the first wavelength. The present invention further provides a method for generating an operating wavelength of a metamaterial panel for use in the aforesaid antenna. These improve the convergence performance and reduce the volume and size of the antenna.

15 Claims, 6 Drawing Sheets

ANTENNA BASED ON A METAMATERIAL AND METHOD FOR GENERATING AN OPERATING WAVELENGTH OF A METAMATERIAL PANEL

FIELD OF THE INVENTION

The present invention generally relates to the field of antennae, and more particularly, to an antenna based on a metamaterial and a method for generating an operating wavelength of a metamaterial panel.

BACKGROUND OF THE INVENTION

In conventional optical devices, a spherical wave radiated from a point light source located at a focus of a lens can be converted into a plane wave after being refracted by the lens. A lens antenna consists of a lens and a radiation source disposed at the focus of the lens. By means of the convergence property of the lens, an electromagnetic wave radiated from the radiation source is converged by the lens before being transmitted outwards. Such an antenna has a high directionality.

Currently, the convergence property of the lens is achieved through a refraction effect of the spherical shape of the lens. As shown in FIG. 1, a spherical wave radiated from a radiation source 30 is converged by a spherical lens 40 and then transmitted outwards in the form of a plane wave. The inventor has found in the process of making this invention that, the lens antenna has at least the following technical problems: the spherical lens 40 is bulky and heavy, which is unfavorable for miniaturization; performances of the spherical lens 40 rely heavily on the shape thereof, and directional propagation from the antenna can be achieved only when the spherical lens 40 has a precise shape; and one antenna can only operate at a single operating frequency and cannot make a response to frequencies other than the operating frequency.

SUMMARY OF THE INVENTION

In view of the defects of existing technologies that are bulky and a single operating frequency point, the present invention provides an antenna based on a metamaterial and a method for generating an operating wavelength of a metamaterial panel.

Technical solution is that provides an antenna based on a metamaterial, which comprises a radiation source, and a metamaterial panel capable of converging an electromagnetic wave and operating at a first wavelength. The metamaterial panel comprises a plurality of core layers and a plurality of gradient layers disposed symmetrically at two sides of the core layers. Each of the core layers and the gradient layers comprises a sheet-like substrate and a plurality of man-made microstructures disposed on the substrate. Each of the man-made microstructures is a two-dimensional (2D) or three-dimensional (3D) structure consisting of at least one metal wire. The metamaterial panel is adapted to convert the electromagnetic wave radiated from the radiation source into a plane wave and to enable the antenna to simultaneously operate at a second wavelength and a third wavelength which are smaller than the first wavelength and are different multiples of the first wavelength. Each of the core layers has the same refractive index distribution, and comprises a circular region and a plurality of annular regions concentric with the circular region. Refractive indices in the circular region and the annular regions decrease continuously from $n_p$ to $n_0$ as the radius increases, and the refractive indices at a same radius are equal to each other.

Preferably, each of the gradient layers located at a same side of the core layers comprises a circular region and a plurality of annular regions concentric with the circular region, and for each of the gradient layers, the variation range of the refractive indices is the same for all of the circular region and the annular regions thereof, the refractive indices decrease continuously from a maximum refractive index to $n_0$ as the radius increases, the refractive indices at a same radius are equal to each other, and the maximum refractive indices of any two adjacent ones of the gradient layers are represented as $n_i$ and $n_{i+1}$, where $n_0<n_i<n_{i+1}<n_p$, i is a positive integer, and $n_i$ corresponds to the gradient layer that is farther from the core layers.

Preferably, the man-made microstructures of each of the core layers have the same geometric form, the man-made microstructures in each of the regions decrease in size continuously as the radius increases, and the man-made microstructures at a same radius have the same size.

Preferably, the man-made microstructures of each of the gradient layers have the same geometric form, the man-made microstructures in each of the regions decrease in size continuously as the radius increases, the man-made microstructures at a same radius have the same size, and for any two adjacent ones of the gradient layers, the man-made microstructures of the gradient layer farther from the core layers have a smaller size than the man-made microstructures in a same region and at the same radius in the gradient layer nearer to the core layers.

Preferably, the refractive indices of each of the layers of the metamaterial panel are:

$$n_i(r)=i*n_{max}/N-(i/(N*d))*(\sqrt{r^2+s^2}-\sqrt{L(j)^2+s^2})*(n_{max}-(N/i)*n_{min})/(n_{max}-n_{min}),$$

where, i represents a serial number of each of the layers, i≥1, and (from outward to inward with respect to the core layers) i=1, 2, . . . ; N=c+1, where c represents the number of the gradient layers at one side; $n_{max}$ represents the maximum refractive index of the core layers, $n_{min}$ represents the minimum refractive index of the core layers; r represents the radius; s represents a distance from the radiation source to the metamaterial panel; d=(b+c)t, b represents the number of the core layers, t represents a thickness of each of the layers, and c represents the number of the gradient layers at one side; L(j) represents a starting radius of each of the regions, j represents a serial number of each of the regions, and j≥1.

Preferably, the man-made microstructures of each of the core layers have the same geometric form, the man-made microstructures in each of the regions decrease in size continuously as the radius increases, and the man-made microstructures at a same radius have the same size.

Preferably, the metal wire is copper wire or silver wire.

Preferably, the metal wire is attached on the substrate through etching, electroplating, drilling, photolithography, electron etching or ion etching.

Technical solution is that the present invention further provides an antenna based on a metamaterial, which comprises a radiation source, and a metamaterial panel capable of converging an electromagnetic wave and operating at a first wavelength. The metamaterial panel is adapted to convert the electromagnetic wave radiated from the radiation source into a plane wave and to enable the antenna to simultaneously operate at a second wavelength and a third wavelength which are smaller than the first wavelength and are different multiples of the first wavelength.

Preferably, the metamaterial panel comprises a plurality of core layers and a plurality of gradient layers disposed symmetrically at two sides of the core layers; and each of the core layers and the gradient layers comprises a sheet-like substrate and a plurality of man-made microstructures disposed on the substrate.

Preferably, each of the core layers has the same refractive index distribution, and comprises a circular region and a plurality of annular regions concentric with the circular region, refractive indices in the circular region and the annular regions decrease continuously from $n_p$ to $n_0$ as the radius increases, and the refractive indices at a same radius are equal to each other.

Preferably, each of the gradient layers located at a same side of the core layers comprises a circular region and a plurality of annular regions concentric with the circular region, and for each of the gradient layers, the variation range of the refractive indices is the same for all of the circular region and the annular regions thereof, the refractive indices decrease continuously from a maximum refractive index to $n_0$ as the radius increases, the refractive indices at a same radius are equal to each other, and the maximum refractive indices of any two adjacent ones of the gradient layers are represented as $n_i$ and $n_{i+1}$, where $n_0<n_i<n_{i+1}<n_p$, i is a positive integer, and $n_i$ corresponds to the gradient layer that is farther from the core layers.

Preferably, the man-made microstructures of each of the core layers have the same geometric form, the man-made microstructures in each of the regions decrease in size continuously as the radius increases, and the man-made microstructures at a same radius have the same size.

Preferably, the man-made microstructures of each of the gradient layers have the same geometric form, the man-made microstructures in each of the regions decrease in size continuously as the radius increases, the man-made microstructures at a same radius have the same size, and for any two adjacent ones of the gradient layers, the man-made microstructures of the gradient layer farther from the core layers have a smaller size than the man-made microstructures in a same region and at the same radius in the gradient layer nearer to the core layers.

Preferably, the refractive indices of each of the layers of the metamaterial panel are:

$$n_i(r)=i*n_{max}/N-(i/(N*d))*(\sqrt{r^2+s^2}-\sqrt{L(j)^2+s^2})*(n_{max}-(N/i)*n_{min})/(n_{max}-n_{min}),$$

where, i represents a serial number of each of the layers, i≥1, and (from outward to inward with respect to the core layers) i=1, 2, . . . ; N=c+1, where c represents the number of the gradient layers at one side; $n_{max}$ represents the maximum refractive index of the core layers, $n_{min}$ represents the minimum refractive index of the core layers; r represents the radius; s represents a distance from the radiation source to the metamaterial panel; d=(b+c)t, b represents the number of the core layers, t represents a thickness of each of the layers, and c represents the number of the gradient layers at one side; L(j) represents a starting radius of each of the regions, j represents a serial number of each of the regions, and j≥1.

Preferably, the man-made microstructures of each of the core layers have the same geometric form, the man-made microstructures in each of the regions decrease in size continuously as the radius increases, and the man-made microstructures at a same radius have the same size.

Preferably, each of the man-made microstructures is a 2D or 3D structure consisting of at least one metal wire.

Preferably, the metal wire is copper wire or silver wire.

Preferably, the metal wire is attached on the substrate through etching, electroplating, drilling, photolithography, electron etching or ion etching.

Preferably, each of the man-made microstructures is of an "I" shape, a "cross" shape or a "王" shape.

The present invention further provides a method for generating an operating wavelength of a metamaterial panel of an antenna. The antenna is capable of operating at a second wavelength $\lambda_2$, and a third wavelength $\lambda_3$ simultaneously. The method comprises:

acquiring a numerical value $m_3/m_2$ that is within a preset error range relative to a ratio $\lambda_3/\lambda_2$ of the third wavelength $\lambda_3$ to the second wavelength $\lambda_2$;

calculating a lowest common multiple $m_1$ of $m_2$ and $m_3$; and generating the operating wavelength $\lambda_1$ of the metamaterial panel, which is represented as $\lambda_1=\lambda_2(m_1/m_2)$ or $\lambda_1=\lambda_3(m_1/m_3)$.

The technical solutions of the present invention have the following benefits: by designing the operating wavelength of the metamaterial panel, the antenna is able to operate at two different wavelengths simultaneously; and by adjusting the refractive indices in the metamaterial panel, the electromagnetic wave radiated from the radiation source can be converted into a plane wave. To improve the convergence performance of the antenna, enhance the transmission distance, and reduce the volume and size of the antenna; and also, this ensures that the antenna can operate at different frequency points (i.e., different wavelengths) so that operating at different frequency points can be achieved without replacing the antenna, thus reducing the cost.

DETAILED DESCRIPTION OF THE INVENTION

Hereinbelow, the present invention will be described in detail with reference to the attached drawings and embodiments thereof.

The metamaterial is a kind of novel material that is formed by man-made microstructures 402 as basic units arranged in the space in a particular manner and that has special electromagnetic responses. The metamaterial comprises the man-made microstructures 402 and a substrate 401 on which the man-made microstructures are attached. Each of the man-made microstructures 402 is a two-dimensional (2D) or three-dimensional (3D) structure consisting of at least one metal wire. A plurality of man-made microstructures 402 are arranged in an array form on the substrate 401. Each of the man-made microstructures 402 and a portion of the substrate 401 that occupies form a metamaterial unit. The substrate 401 may be made of any material different from that of the man-made microstructures 402, and use of the two different materials impart to each metamaterial unit an equivalent dielectric constant and an equivalent magnetic permeability, which correspond to responses of the metamaterial unit to the electric field, and to the magnetic field respectively. The electromagnetic response characteristics of the metamaterial is determined by properties of the man-made microstructures 402 which, in turn, are largely determined by topologies and geometric dimensions of the metal wire patterns of the man-made microstructures 402. By designing the topology pattern and the geometric dimensions of each of the man-made microstructures 402 of the metamaterial that are arranged in the space according to the aforesaid principle, the electromagnetic parameters of the metamaterial at each point can be set.

Figure 1:
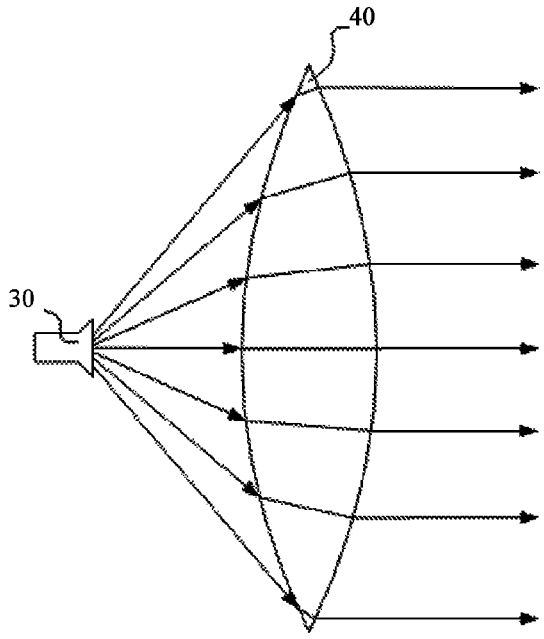
FIG. 1 is a schematic view illustrating how the lens antenna of a spherical form converges an electromagnetic wave in the existing technologies.
Figure 2:
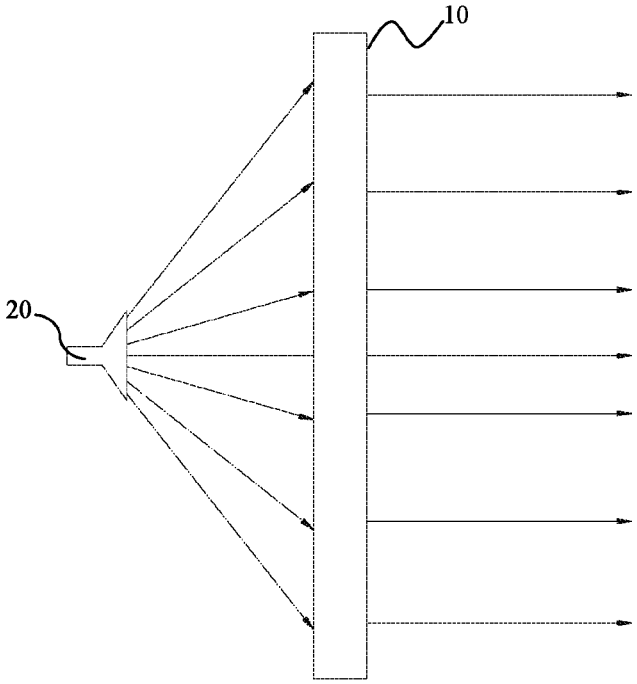
FIG. 2 is a schematic view illustrating how an antenna based on a metamaterial according to an embodiment of the present invention converges an electromagnetic wave.

FIG. 2 illustrates an antenna based on a metamaterial, which comprises a radiation source 20, and a metamaterial panel 10 capable of converging an electromagnetic wave and operating at a first wavelength $\lambda_1$. The metamaterial panel 10 is adapted to convert the electromagnetic wave radiated from the radiation source 20 into a plane wave and to enable the antenna to simultaneously operate at a second wavelength $\lambda_2$ and a third wavelength $\lambda_3$ which are smaller than the first wavelength $\lambda_1$ and are different multiples of the first wavelength $\lambda_1$. The converging effect of the antenna on the electromagnetic wave is shown in FIG. 2.

Figure 3:
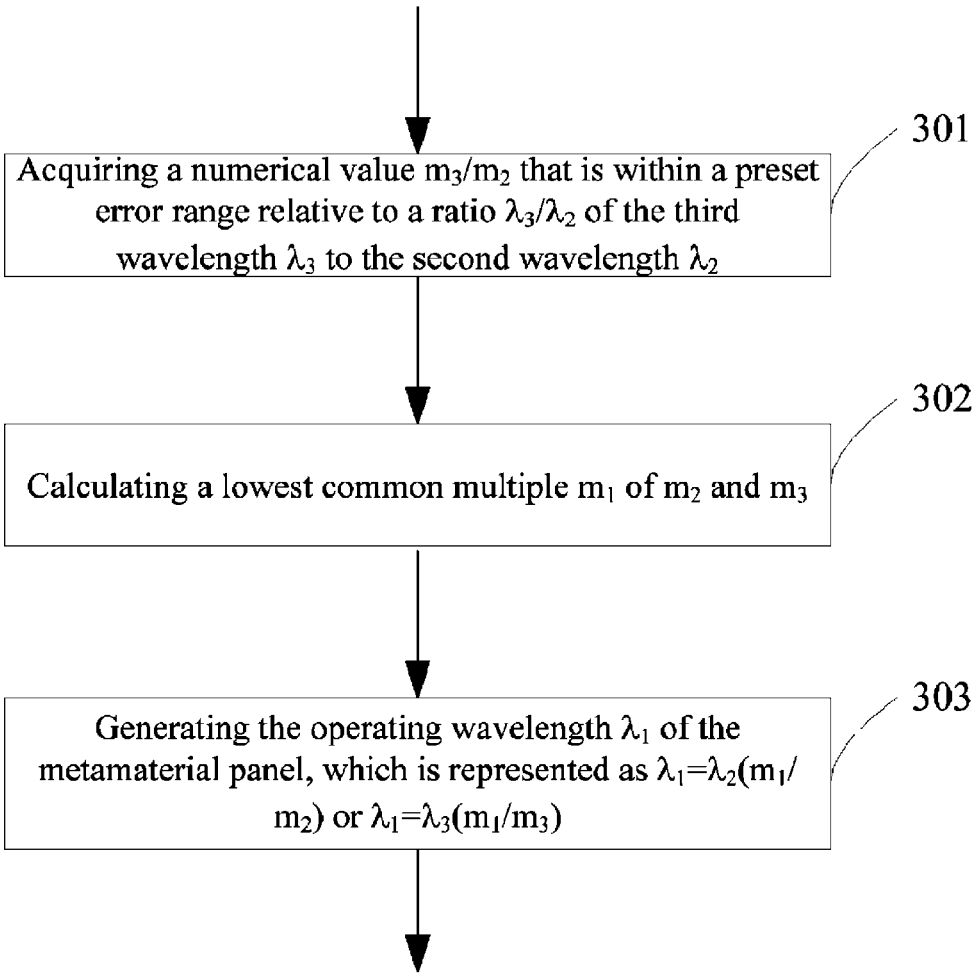
FIG. 3 is a flowchart diagram of a method for generating an operating wavelength of a metamaterial panel 10 shown in FIG. 2.

If it is desired to make the antenna operate at two different frequencies which correspond to the second wavelength $\lambda_2$ and the third wavelength $\lambda_3$ respectively, then the first wavelength $\lambda_1$ at which the metamaterial panel 10 operates must be calculated. The process of generating the first wavelength $\lambda_1$ is as shown in FIG. 3, and will be detailed as follows:

Step 301: acquiring a numerical value $m_3/m_2$ ($m_3$ are $m_2$ are positive integers) that is within a preset error range relative to a ratio $\lambda_3/\lambda_2$ of the third wavelength $\lambda_3$ to the second wavelength $\lambda_2$, wherein the preset error range can be set according to the calculation accuracy (e.g., 0.01);

Step 302: calculating a lowest common multiple $m_1$ of $m_2$ and $m_3$; and Step 303: generating the operating wavelength $\lambda_1$ of the metamaterial panel 10, which is represented as $\lambda_1=\lambda_2(m_1/m_2)$ or $\lambda_1=\lambda_3(m_1/m_3)$.

As an example, if $\lambda_2$=2 cm and $\lambda_3$=3 cm, then it can be obtained through the aforesaid calculation process that $\lambda_1$=6 cm.

As can be known as a common knowledge, the refractive index of the electromagnetic wave is proportional to $\sqrt{\epsilon\times\mu}$. When an electromagnetic wave propagates from a medium to another medium, the electromagnetic wave will be refracted; and if the refractive index distribution in the material is non-uniform, then the electromagnetic wave will be deflected towards a site having a large refractive index. By designing electromagnetic parameters of the metamaterial at each point, the refractive index distribution of the metamaterial can be adjusted so as to achieve the purpose of changing the propagating path of the electromagnetic wave. According to the aforesaid principle, the refractive index distribution of the metamaterial panel 10 can be designed in such a way that an electromagnetic wave diverging in the form of a spherical wave that is radiated from the radiation source 20 is converted into a plane electromagnetic wave suitable for long-distance transmission.

Figure 4:
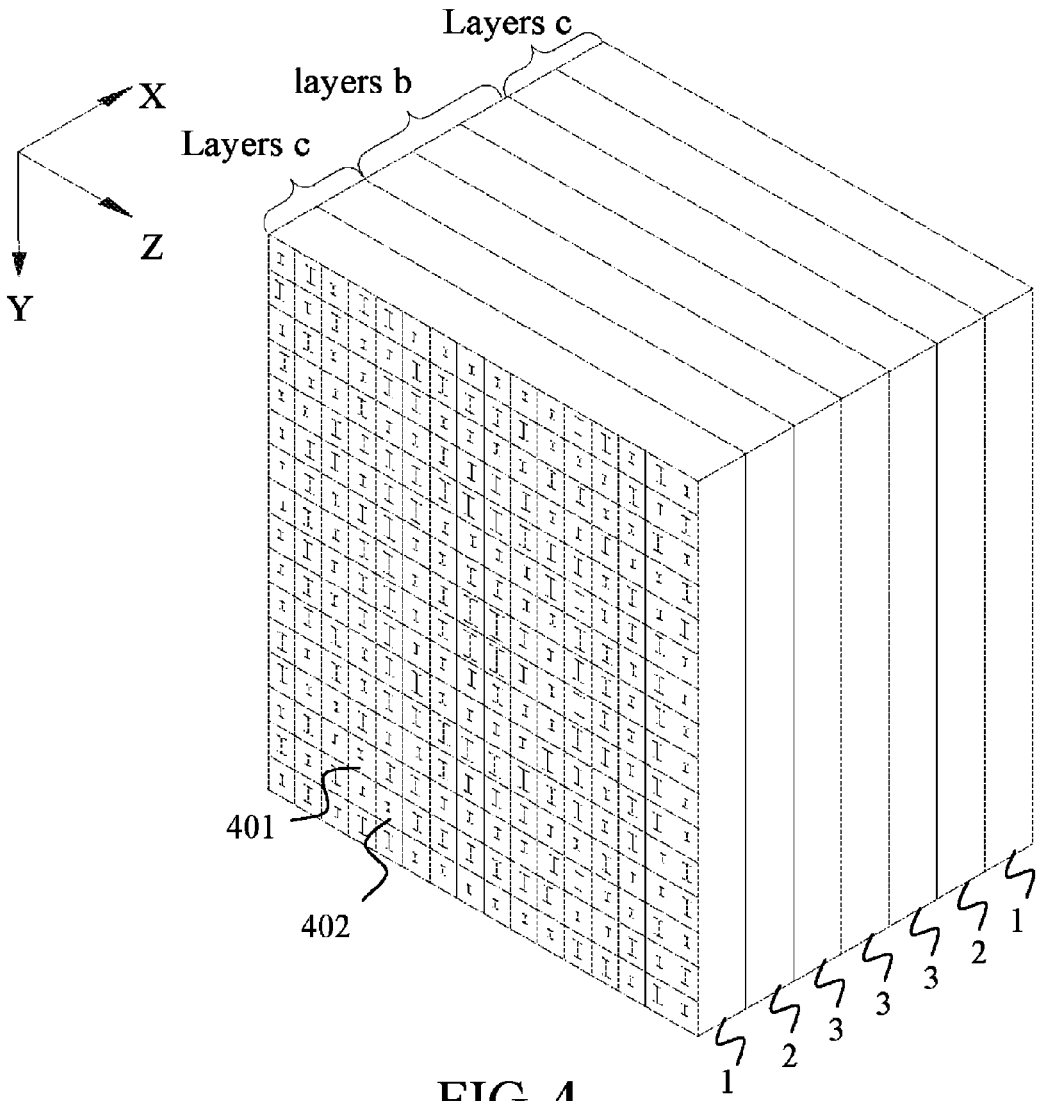
FIG. 4 is a schematic structural view of the metamaterial panel 10 shown in FIG. 2.

FIG. 4 is a schematic structural view of the metamaterial panel 10 shown in FIG. 2. The metamaterial panel 10 comprises a plurality of core layers and a plurality of gradient layers that are disposed symmetrically at two sides of the core layers, and each of the core layers and the gradient layers comprises a sheet-like substrate 401 and a plurality of man-made microstructures 402 disposed on the substrate 401. Each of the man-made microstructures 402 and a portion of the substrate 401 that occupies form a metamaterial unit. The metamaterial panel 10 is formed by a plurality of metamaterial sheet layers stacked together. The metamaterial sheet layers are arranged and assembled together equidistantly, or are connected integrally with a front surface of one sheet layer being adhered to a back surface of an adjacent sheet layer. In practical implementations, the number of metamaterial sheet layers may be designed depending on practical needs. Each of the metamaterial sheet layers is formed of a plurality of metamaterial units arranged in an array, so the whole metamaterial panel 10 may be considered to be formed by a plurality of metamaterial units arrayed in the x, y and z directions. Through design of the topological patterns, geometric dimensions and distributions thereof on the substrate 401 of the man-made microstructures 402, the following rules can be satisfied by the refractive index distribution of the middle core layers: the refractive index distribution is the same for each of the layers, each of the core layers comprises a circular region and a plurality of annular regions concentric with the circular region, refractive indices of each of the circular region and the annular regions decrease continuously from $n_p$ to $n_0$ as the radius increases, and points at a same radius have the same refractive index.

As shown in FIG. 4, there are shown only seven layers, with the three middle layers being the core layers 3 and the gradient layers 1, 2 being at two sides of the core layers. Moreover, the gradient layers at the two sides are distributed symmetrically; that is, the gradient layers at a same distance from the core layers have the same property. The numbers of the core layers and of the gradient layers of the metamaterial panel in FIG. 4 are only illustrative, and may be determined as needed. Supposing that the final metamaterial panel has a thickness D, each of the layers has a thickness t, the number of the gradient layers at a side of the core layers is c, the metamaterial panel 10 operates at a wavelength $\lambda_1$, a variation interval of the refractive indices of each of the core layers is $n_{max}$~$n_{min}$, $\Delta n=n_{max}-n_{min}$, and the number of the core layers is b, then the number b of the core layers and the number c of the gradient layers have the following relationships: $(b+c)t=\lambda_1/\Delta n$; and $D=b+2c$. The gradient layers mainly function to buffer the refractive indices to avoid large variations from occurring when the electromagnetic wave is incident and to reduce the reflection of the electromagnetic wave, and also have the functions of impedance matching and phase compensation.

Figure 5:
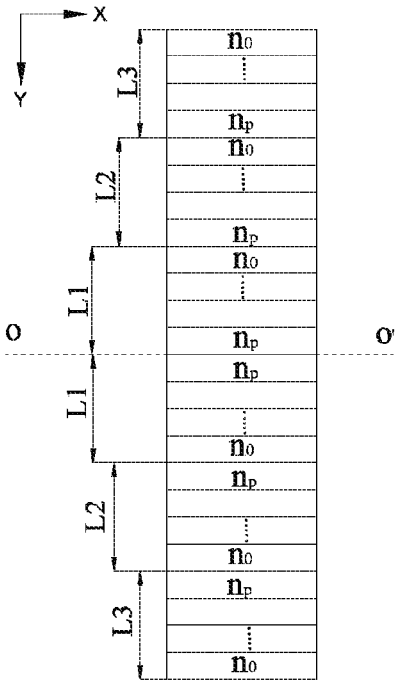
FIG. 5 is a schematic view illustrating how refractive indices of each of core layers vary with a radius.

For example there are three core layers and two gradient layers at each of the two sides of the core layers. Each of the three middle core layers has the same refractive index distribution, and comprises a circular region and a plurality of annular regions concentric with the circular region; refractive indices in the circular region and the annular regions decrease continuously from $n_p$ to $n_0$ as the radius increases; and the refractive indices at a same radius are equal to each other. FIG. 5 is a schematic view illustrating how the refractive indices of each of the core layers vary with the radius. As an example, each of the core layers comprises three regions: namely, a circular first region having a radius of L1, an annular second region having a width varying from L1 to L2, and an annular third region having a width varying from L2 to L3. The refractive indices of each of the three regions decrease gradually from $n_p$ (i.e., $n_{max}$) to $n_0$(i.e., $n_{min}$) as the radius increases, where $n_p>n_0$. The refractive index distribution is the same for each of the metamaterial sheet layers.

Figure 6:
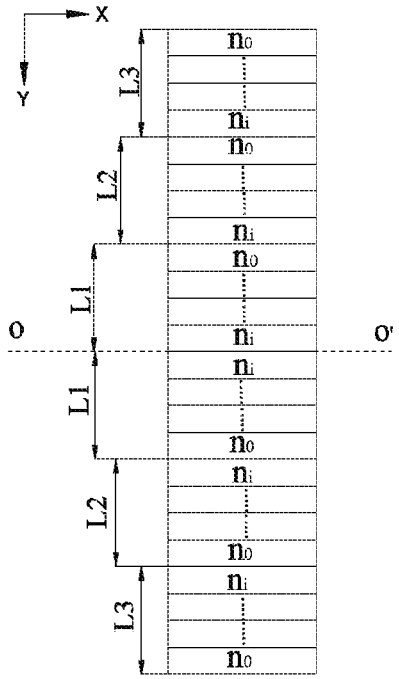
FIG. 6 is a schematic view illustrating how refractive indices of each of gradient layers vary with the radius.

FIG. 6 is a schematic view illustrating how the refractive indices of each of the gradient layers vary with the radius. The refractive index distribution of each of the gradient layers is similar to that of each of the core layers except the different maximum refractive index of each region. Specifically, as compared to the maximum refractive index $n_p$ of each of the core layers, the maximum refractive index of each of the gradient layers is $n_i$, and different gradient layers have different maximum refractive indices $n_i$. Each of the gradient layers located at a same side of the core layers comprises a circular region and a plurality of annular regions concentric with the circular region. The maximum refractive indices in respective circular regions and annular regions of any two adjacent ones of the gradient layers are represented as $n_i$ and $n_{i+1}$, where $n_0<n_i<n_{i+1}<n_p$, i is a positive integer, and $n_i$ corresponds to the gradient layer that is farther from the core layers. For each of the gradient layers, the refractive indices in the circular region and the annular regions decrease continuously from the maximum refractive index to $n_0$ as the radius increases, and the refractive indices at a same radius are equal to each other. That is, as shown in FIG. 4, for the two gradient layers at the left side of the core layers, the leftmost gradient layer has a maximum refractive index $n_1$ and the other gradient layer has a maximum refractive index $n_2$, where $n_0<n_1<n_2<n_p$. Likewise, because the gradient layers at the two sides of the core layers are distributed symmetrically, the rightmost gradient layer has the same refractive index distribution as the leftmost gradient layer and the second rightmost gradient layer has the same refractive index distribution as the second leftmost gradient layer.

How the refractive index distribution of each of the layers of the metamaterial panel varies with the radius r may be represented by the following formula:

$$n_i(r)=i*n_{max}/N-(i/(N*d))*(\sqrt{r^2+s^2}-\sqrt{L(j)^2+s^2})*(n_{max}-(N/i)*n_{min})/(n_{max}-n_{min}),$$

where i represents a serial number of each of the layers, i≥1, and (from outward to inward with respect to the core layers) i=1, 2, . . . ; N=c+1, where c represents the number of the gradient layers at one side; $n_{max}$ represents the maximum refractive index of the core layers, $n_{min}$ represents the minimum refractive index of the core layers; r represents the radius; s represents a distance from the radiation source to the metamaterial panel; d=(b+c)t, b represents the number of the core layers, t represents a thickness of each of the layers, and c represents the number of the gradient layers at one side; L(j) represents a starting radius of each of the regions, j represents a serial number of each of the regions, and j≥1. L(1) represents a starting radius of the first region (i.e., the circular region), so L(1)=0; L(2) represents a starting radius of the second region (i.e., an annular region); L(3) represents a starting radius of the third region (i.e., an annular region), and so on. As shown in FIG. 5, L(2)=L1, L(3)=L1+L2, and L(4)=L1+L2+L3. Whether for the gradient layers or for the core layers, the starting radius L(j) of each region of each layer has the same value. If it is desired to calculate the refractive index n(r) of the first region, then the starting radius L(j) in the aforesaid formula is L(1)=0; if it is desired to calculate the refractive index n(r) of the second region, then the starting radius L(j) in the aforesaid formula is L(2); and so on.

For the metamaterial panel as shown in FIG. 4, i in the aforesaid formula is 1 for the gradient layers labeled with the reference number 1, i in the aforesaid formula is 2 for the gradient layers labeled with the reference number 2, i is 3 for the core layers labeled with the reference number 3, the number of the gradient layers at a side is c=2, the number of the core layers is b=3, and N=c+1=3.

Hereinbelow, the meanings of the aforesaid formula will be explained in detail by taking a set of experiment data as an example: the incident electromagnetic wave has a frequency f=15 GHz and a wavelength $\lambda_1$=2 cm; wavelengths at which the antenna can operate simultaneously are $\lambda_2$=0.67 cm and $\lambda_3$=1 cm (of course, $\lambda_1$ is also an operating wavelength of the antenna; that is, the antenna can operate at least at three wavelengths simultaneously); $n_{max}$=6; $n_{min}$=1; Δn=5; s=20 cm; L(1)=0 cm; L(2)=9.17 cm; L(3)=13.27 cm; L(4)=16.61 cm; c=2; N=c+1=3; each of the layers has a thickness t=0.818 mm; according to the relationship (b+c)t=$\lambda_1$/Δn between the number b of the core layers and the number c of the gradient layers, it can be obtained that b=3; and d=(b+c)t=5*0.818. The refractive index distribution of each of the layers of the metamaterial panel is as follows.

For each of the gradient layers, (from outward to inward with respect to the core layers) i=1, 2.

The first gradient layer:

$$\begin{aligned} n_1(r) &= i*n_{max}/N-(i/(N*d))*\left(\sqrt{r^2+s^2}-\sqrt{L(j)^2+s^2}\right)* \\ &\quad (n_{max}-(N/i)*n_{min})/(n_{max}-n_{min}) \\ &= 1*6/3-(1/(3*5*0.818\text{ mm}))* \\ &\quad \left(\sqrt{r^2+20^2\text{cm}^2}-\sqrt{L(j)^2+20^2\text{cm}^2}\right)*(6-(3/1)*1)/5 \end{aligned}$$

Each of the regions in the first gradient layer has a different starting radius L(j). Specifically, for the first region j=1, L(j)=L(1)=0; for the second region j=2, L(j)=L(2)=9.17 cm; and for the third region j=3, L(j)=L(3)=13.27 cm.

The second gradient layer:

$$\begin{aligned} n_2(r) &= i*n_{max}/N-(i/(N*d))*\left(\sqrt{r^2+s^2}-\sqrt{L(j)^2+s^2}\right)* \\ &\quad (n_{max}-(N/i)*n_{min})/(n_{max}-n_{min}) \\ &= 2*6/3-(2/(3*5*0.818\text{ mm}))* \\ &\quad \left(\sqrt{r^2+20^2\text{cm}^2}-\sqrt{L(j)^2+20^2\text{cm}^2}\right)*(6-(3/2)*1)/5 \end{aligned}$$

Each of the regions in the second gradient layer has a different starting radius L(j). Specifically, for the first region j=1, L(j)=L(1)=0; for the second region j=2, L(j)=L(2)=9.17 cm; and for the third region j=3, L(j)=L(3)=13.27 cm.

Each of the core layers has the same refractive index distribution; that is, the refractive indices of each of the core layers are $n_3(r)$:

$$n_3(r) = i*n_{max}/N - (i/(N*d))*\left(\sqrt{r^2+s^2} - \sqrt{L(j)^2+s^2}\right)*$$
$$(n_{max} - (N/i)*n_{min})/(n_{max} - n_{min})$$
$$= 3*6/3 - (3/(3*5*0.818\ \text{mm}))*$$
$$\left(\sqrt{r^2+20^2\text{cm}^2} - \sqrt{L(j)^2+20^2\text{cm}^2}\right)*(6-(3/3)*1)/5$$

According to the aforesaid formula, the following rules can be obtained: the maximum refractive index of each of the layers of the metamaterial panel decreases in sequence from left to right. For example, the maximum refractive index of the first gradient layer is n=2, the maximum refractive index of the second gradient layer is n=4, and the maximum refractive index of the third core layer, the fourth core layer and the fifth core layer is n=6. The gradient layers are distributed symmetrically, so for the gradient layers at the right side from right to left, the maximum refractive index of the first gradient layer is n=2 and the maximum refractive index of the second gradient layer is n=4. That is, the maximum refractive indices $n_i$ (the smaller the distance to the core layers is, the larger the value of i will be) of the gradient layers shown in FIG. 6 satisfy the following rule: $n_{i+1}>n_i$; and the maximum refractive index of the core layers is $n_p$. The aforesaid values in the formula are only illustrative, but are not intended to limit the present invention. In practical applications, the values may be adjusted as needed. For example, the maximum refractive indices, the minimum refractive indices, the number of the gradient layers and so on may all be altered as needed.

For an electromagnetic wave diverging in the form of a spherical wave that is radiated from the radiation source 20, the refractive index variations of the metamaterial panel 10 that satisfies the aforesaid rules of refractive index variations increase gradually in a yz plane as the radius increases with the metamaterial unit having the refractive index of $n_i$ or $n_p$ as a circle center. The deflection angle exhibited by the incident electromagnetic wave when exiting increases as the radius increases, and the closer a metamaterial unit is to the circle center, the smaller the exiting deflection angle of the electromagnetic wave will be. Through appropriate design and calculations, certain rules can be satisfied by the deflection angles so that an electromagnetic wave of a spherical form can exit in parallel. Similar to a convex lens, given that the deflection angle and the refractive index at each point of a surface are known, a corresponding surface curvature profile can be designed so that a divergent electromagnetic wave incident from a focus of the lens can exit in parallel. Likewise, by designing the man-made microstructures of each of the metamaterial units in the antenna based on the metamaterial of the present invention, a dielectric constant c and magnetic permeability μ of each of the metamaterial units can be obtained. Then, the refractive index distribution of the metamaterial panel 10 is designed in such a way that a specific deflection angle can be achieved for the electromagnetic wave through variations in refractive index between adjacent metamaterial units. Thereby, the electromagnetic wave that is diverging in the form of a spherical wave can be converted into a plane wave.

Figure 7:
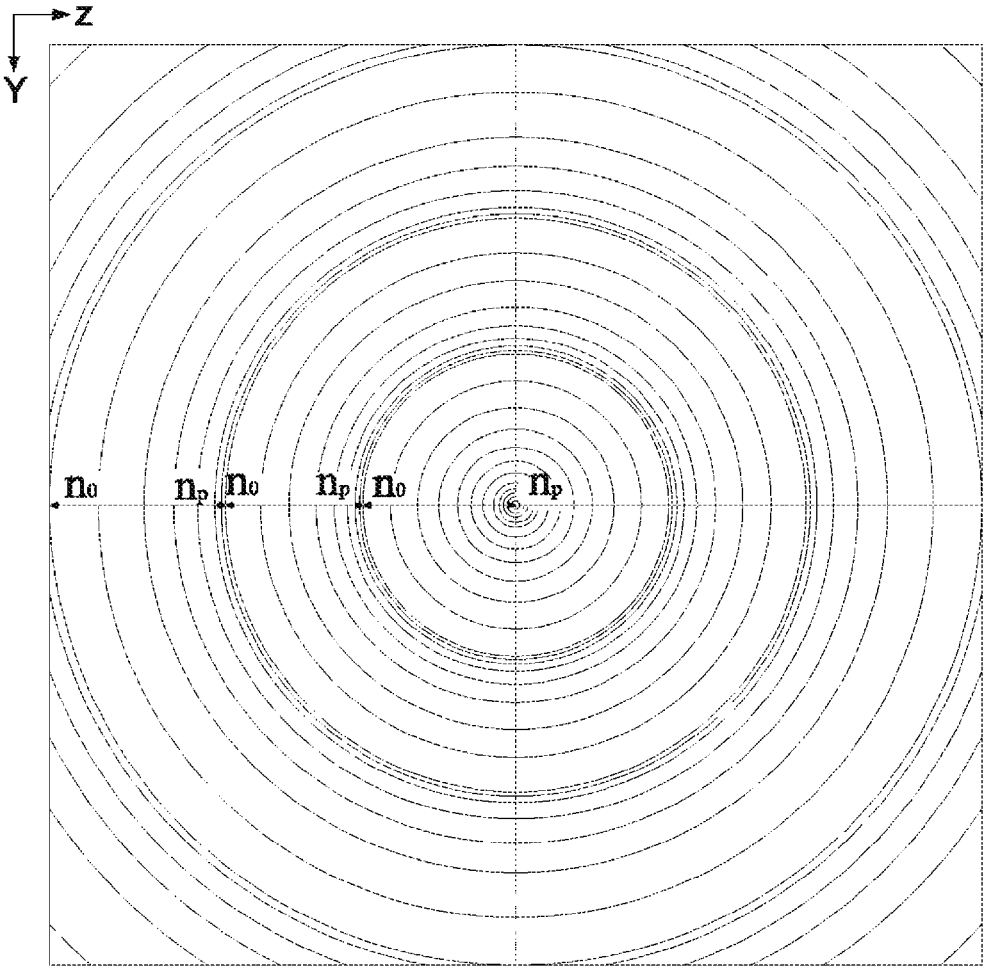
FIG. 7 is a diagram illustrating the refractive index distribution of each of the core layers of the metamaterial panel in a yz plane.
Figure 8:
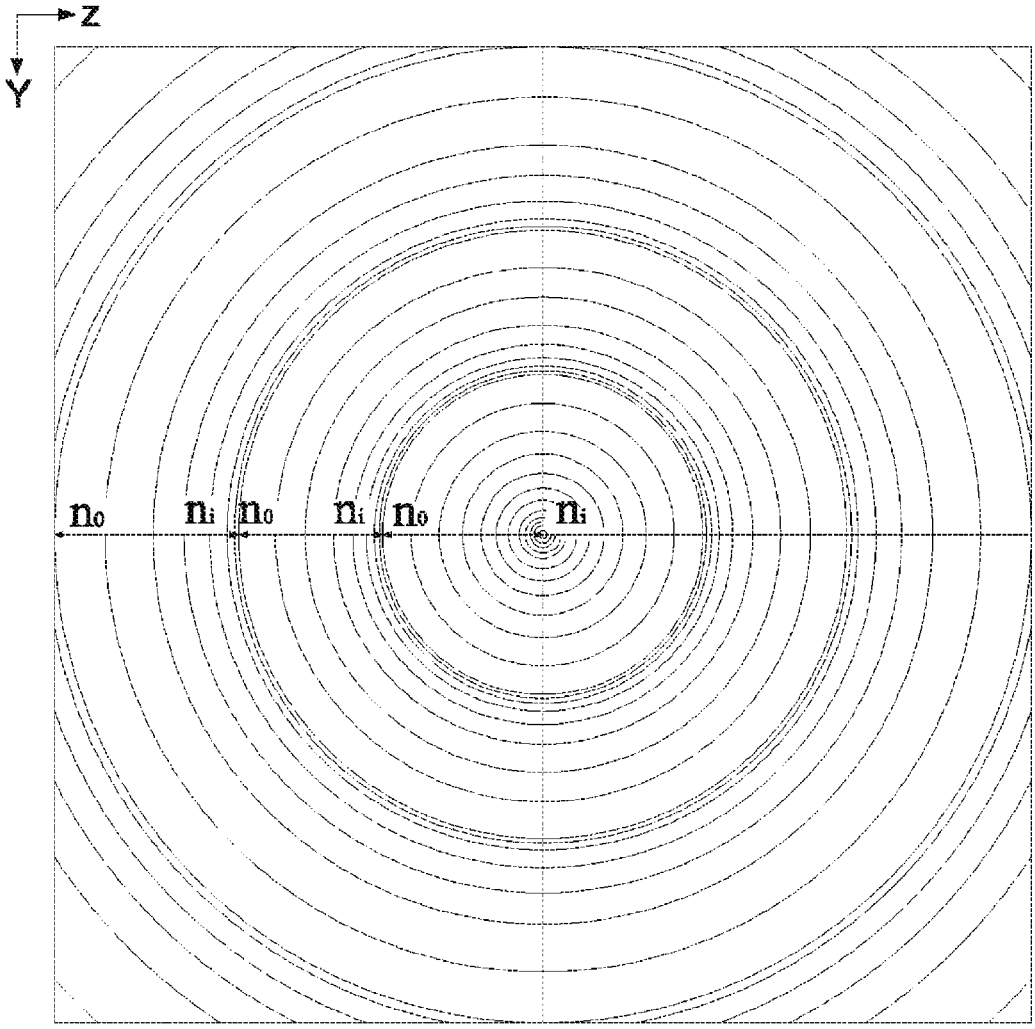
FIG. 8 is a diagram illustrating the refractive index distribution of an $i^{th}$ gradient layer of the metamaterial panel in the yz plane.

In order to more intuitively represent the refractive index distribution of each of the metamaterial sheet layers in the YZ plane, the metamaterial units having the same refractive index are connected to form a line, and the magnitude of the refractive index is represented by the density of the lines. A larger density of the lines represents a larger refractive index. The refractive index distribution of each of the core layers of the metamaterial sheet layers satisfying all of the above relational expressions is as shown in FIG. 7, with the maximum refractive index being $n_p$ and the minimum refractive index being $n_0$. The refractive index distribution of each of the gradient layers is similar to that of each of the core layers except that the gradient layers have different maximum refractive indices from each other. As shown in FIG. 8, the $i^{th}$ gradient layer has a maximum refractive index $n_i$ and a minimum refractive index $n_0$; and the maximum refractive indices $n_i$ (the smaller the distance to the core layers is, the larger the value of i will be) of the gradient layers satisfy the following rule: $n_{i+1}>n_i$.

As has been proved through experiments, for the man-made microstructures 402 having the same pattern, the dimensions thereof are proportional to the dielectric constants ∈. Therefore, given that an incident electromagnetic wave is determined, by appropriately designing topology patterns of the man-made microstructures 402 and designing arrangement of the man-made microstructures 402 of different dimensions on each of the metamaterial sheet layers, the refractive index distribution of the metamaterial panel 10 can be adjusted to convert the electromagnetic wave diverging in the form of a spherical wave into a plane electromagnetic wave.

The man-made microstructures 402 having the refractive indices and the refractive index variation distribution described above may be implemented in many forms. For a 2D man-made microstructure 402, the geometry thereof may be or not be in axial symmetry; and for a 3D man-made microstructure, it may have any non-90° rotationally symmetrical 3D pattern.

Each of the man-made microstructures is a 2D or 3D structure consisting of at least one metal wire. The metal wire is copper wire or silver wire, and may be attached on the substrate through etching, electroplating, drilling, photolithography, electron etching or ion etching.

The present invention further provides a method for generating an operating wavelength of a metamaterial panel for use in the aforesaid antenna based on a metamaterial, which is as shown in FIG. 3. The antenna is capable of operating at a second wavelength $\lambda_2$ and a third wavelength $\lambda_3$ simultaneously. The method comprises the following steps of:

1) acquiring a numerical value $m_3/m_2$ ($m_3$ and $m_2$ are positive integers) that is within a preset error range relative to a ratio $\lambda_3/\lambda_2$ of the third wavelength $\lambda_3$ to the second wavelength $\lambda_2$;

2) calculating a lowest common multiple $m_1$ of $m_2$ and $m_3$; and 3) generating the operating wavelength $\lambda_1$ of the metamaterial panel, which is represented as $\lambda_1=\lambda_2(m_1/m_2)$ or $\lambda_1=\lambda_3(m_1/m_3)$.

According to the present invention, by designing the operating wavelength of the metamaterial panel, the antenna is able to operate at two different wavelengths simultaneously; and by adjusting variations of the refractive indices in the metamaterial panel, the electromagnetic wave radiated from the radiation source can be converted into a plane wave. This improves the converging performance of the antenna, enlarges the transmission distance, and reduces the volume and size of the antenna; and also, this ensures that the antenna can operate at different frequencies (i.e., different wavelengths) so that operation at different frequencies can be achieved without the need of replacing the antenna, thus reducing the cost.

The embodiments of the present invention have been described above with reference to the attached drawings; however, the present invention is not limited to the aforesaid embodiments, and these embodiments are only illustrative but are not intended to limit the present invention. Those of ordinary skill in the art may further devise many other implementations according to the teachings of the present invention without departing from the spirits and the scope claimed in the claims of the present invention, and all of the implementations shall fall within the scope of the present invention.

What is claimed is:

1. A metamaterial device, comprising:

a metamaterial panel having a thickness between a first panel side surface and a second panel side surface, configured such that the first and second panel side surfaces are perpendicularly disposed to propagation direction of plane electromagnetic waves exiting the second panel side surface, wherein an electromagnetic wave diverging in the form of a spherical wave is emitted from a radiation source and incident on the first panel side surface;

wherein the metamaterial panel comprises a first layer having a plurality of core layers and a second and third layer each having a plurality of gradient layers, wherein the second layer is layered on a first side of the first layer, and the third layer is layered on a second side of the first layer which is opposite the first side, so that the second and third layers are symmetrically distributed about the core layers, each of the core layers and each of the gradient layers comprises a sheet-like substrate and a plurality of man-made microstructures attached on the substrate, each of the man-made microstructures is a two-dimensional (2D) or three-dimensional (3D) structure consisting of at least one metal wire; and wherein each of the core layers has the same refractive index distribution, and comprises a circular region and a plurality of annular regions concentric with the circular region, wherein refractive indices in the circular region and the annular regions decrease continuously from np to no as the radius from the center of the circular region increases, and the refractive indices at a same radius are equal to each other.

2. The metamaterial device of claim 1, wherein each of the gradient layers located at a same side of the core layers comprises a circular region and a plurality of annular regions concentric with the circular region, and for each of the gradient layers, the variation range of the refractive indices is the same for all of the circular region and the annular regions thereof, the refractive indices decrease continuously from a maximum refractive index to no as the radius increases, the refractive indices at a same radius are equal to each other, and the maximum refractive indices of any two adjacent ones of the gradient layers are represented as ni and ni+b where n0 i is a positive integer, and ni corresponds to the gradient layer that is farther from the core layers.

3. The matematerial device of claim 2, wherein the man-made microstructures of each of the core layers have the same geometric form, the man-made microstructures in each of the regions decrease in size continuously as the radius increases, and the man-made microstructures at a same radius have the same size.

4. The matematerial device of claim 3, wherein the man-made microstructures of each of the gradient layers have the same geometric form, the man-made microstructures in each of the regions decrease in size continuously as the radius increases, the man-made microstructures at a same radius have the same size, and for any two adjacent ones of the gradient layers, the man-made microstructures of the gradient layer farther from the core layers have a smaller size than the man-made microstructures in a same region and at the same radius in the gradient layer nearer to the core layers.

5. The metamaterial device of claim 4, wherein the refractive indices of each of the layers of the metamaterial panel are: ni(r)=i*nmax/N−(i/(N*d))*(~+s2−4L(j)2+s2)*(nmax−(N/i)*nmin)/(nmax−nmin),2 0 where, i represents a serial number of each of the layers, i1, and (from outward to inward with respect to the core layers) i=1, 2, . . . ; N=c+1, where c represents the number of the gradient layers at one side; nmax represents the maximum refractive index of the core layers, nmin represents the minimum refractive index of the core layers; r represents the radius; s represents a distance from the radiation source to the metamaterial panel; d=(b+c)t, b represents the number of the core layers, t represents a thickness of each of the layers, and c represents the number of the gradient layers at one side; L(j) represents a starting radius of each of the regions, j represents a serial number of each of the regions, and j>1.

6. The metamaterial device of claim 1, wherein the metal wire is copper wire or silver wire.

7. The metamaterial device of claim 1, wherein the metal wire is attached on the substrate through etching, electroplating, drilling, photolithography, electron etching or ion etching.

8. An antenna based on a metamaterial, comprising:

a radiation source, and a metamaterial panel having a thickness between a first panel side surface and a second panel side surface, configured such that the first and second panel side surfaces are perpendicularly disposed to propagation direction of plane electromagnetic waves exiting the second panel side surface, wherein an electromagnetic wave diverging in the form of a spherical wave is emitted from the radiation source and incident on the first panel side surface, configured to operate at a first wavelength; wherein the metamaterial panel comprises a first layer having a plurality of core layers and a second and third layer each having a plurality of gradient layers, wherein the second layer is layered on a first side of the first layer, and the third layer is layered on a second side of the first layer which is opposite the first side, so that the second and third layers are symmetrically distributed about the core layers, each of the core layers and each of the gradient layers comprises a sheet-like substrate and a plurality of man-made microstructures attached on the substrate, each of the man-made microstructures is a two-dimensional (2D) or three-dimensional (3D) structure consisting of at least one metal wire, and the metamaterial panel configured to simultaneously operate the antenna at a second wavelength and a third wavelength which are shorter than the first wavelength and are different multiples of the first wavelength; and wherein each of the core layers has the same refractive index distribution, and comprises a circular region and a plurality of annular regions concentric with the circular region, wherein refractive indices in the circular region and the annular regions decrease continuously from np to no as the radius from the center of the circular region increases, and the refractive indices at a same radius are equal to each other.

9. The antenna of claim 8, wherein each of the gradient layers located at a same side of the core layers comprises a circular region and a plurality of annular regions concentric with the circular region, and for each of the gradient layers, the variation range of the refractive indices is the same for all of the circular region and the annular regions thereof, the refractive indices decrease continuously from a maximum refractive index to $n_0$ as the radius increases, the refractive indices at a same radius are equal to each other, and the maximum refractive indices of any two adjacent ones of the gradient layers are represented as $n_i$ and $n_{i+1}$, where $n_0<n_i<n_{i+1}<n_p$, i is a positive integer, and $n_i$ corresponds to the gradient layer that is farther from the core layers.

10. The antenna of claim 9, wherein the man-made microstructures of each of the core layers have the same geometric form, the man-made microstructures in each of the regions decrease in size continuously as the radius increases, and the man-made microstructures at a same radius have the same size.

11. The antenna of claim 10, wherein the man-made microstructures of each of the gradient layers have the same geometric form, the man-made microstructures in each of the regions decrease in size continuously as the radius increases, the man-made microstructures at a same radius have the same size, and for any two adjacent ones of the gradient layers, the man-made microstructures of the gradient layer farther from the core layers have a smaller size than the man-made microstructures in a same region and at the same radius in the gradient layer nearer to the core layers.

12. The antenna of claim 11, wherein the refractive indices of each of the layers of the metamaterial panel are:

$$n_i(r)=i*n_{max}/N-(i/(N*d))*(\sqrt{r^2+s^2}-\sqrt{L(j)^2+s^2})*(n_{max}-(N/t)*n_{min})/(n_{max}-n_{min}),$$

where, i represents a serial number of each of the layers, $i\geq 1$, and (from outward to inward with respect to the core layers) i=1, 2, . . . ; N=c+1, where c represents the number of the gradient layers at one side; $n_{max}$ represents the maximum refractive index of the core layers, $n_{min}$ represents the minimum refractive index of the core layers; r represents the radius; s represents a distance from the radiation source to the metamaterial panel; d=(b+c) t, b represents the number of the core layers, t represents a thickness of each of the layers, and c represents the number of the gradient layers at one side; L(j) represents a starting radius of each of the regions, j represents a serial number of each of the regions, and $j\geq 1$.

13. The antenna of claim 8, wherein each of the man-made microstructures is a 2D or 3D structure consisting of at least one metal wire.

14. The antenna of claim 13, wherein the metal wire is copper wire or silver wire.

15. The antenna of claim 13, wherein the metal wire is attached on the substrate through etching, electroplating, drilling, photolithography, electron etching or ion etching.

* * * * *